US011644771B2

(12) United States Patent
Nimura

(10) Patent No.: US 11,644,771 B2
(45) Date of Patent: May 9, 2023

(54) IMAGE FORMING APPARATUS

(71) Applicant: Canon Kabushiki Kaisha, Tokyo (JP)

(72) Inventor: Masanori Nimura, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/554,262

(22) Filed: Dec. 17, 2021

(65) Prior Publication Data

US 2022/0197198 A1 Jun. 23, 2022

(30) Foreign Application Priority Data

Dec. 22, 2020 (JP) ..... JP2020-212661

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS 5,138,379 A 8/1992 Kanazashi
6,671,488 B2 12/2003 Izawa et al.
2015/0110508 A1* 4/2015 Nishi ..... G03G 21/203 399/96

FOREIGN PATENT DOCUMENTS

JP 04104284 A 4/1992

* cited by examiner

*Primary Examiner* — Clayton E. LaBalle
*Assistant Examiner* — Michael A Harrison
(74) *Attorney, Agent, or Firm* — Venable LLP

(57) ABSTRACT

An image forming apparatus includes a first sensor configured to detect a temperature; an image forming unit configured to form an image; a sheet container configured to contain sheets; a conveyance roller configured to convey a sheet from the sheet container; a transfer unit configured to transfer the image on the sheet conveyed by the conveyance roller; a fixing unit configured to fix the image on the sheet by heating the image on the sheet; a second sensor configured to detect a temperature of the fixing unit; a sheet container heater configured to heat the sheet in the sheet container, wherein the sheet container heater is provided at a position where a distance from the first sensor to the sheet container heater is closer than a distance from the fixing unit to the sheet container heater.

7 Claims, 7 Drawing Sheets

IMAGE FORMING APPARATUS

BACKGROUND OF THE INVENTION

Field of the Invention

The present disclosure relates to an image forming apparatus having a fixing device to fix an unfixed toner image on a recording material such as a sheet.

Description of the Related Art

The fixing device heats and melts, for example, as to a recording material supporting an unfixed toner image, the unfixed toner image to pressurize the fused toner image and the recording material. Thereby the toner image is fixed on the recording material. Such a fixing device includes a fixing roller, in which a heater is installed for heating the toner image, and a pressing roller. The pressing roller is pressed against the fixing roller to form a nip portion between the pressing roller and the fixing roller. A fixing method of fixing the toner image by the fixing device having the fixing roller and the pressing roller is referred to as a roller fixing method.

In recent years, a fixing device in which a fixing roller is formed by using a belt-shaped film may also be used. Such a fixing method for fixing the toner image using the fixing device is referred to as a belt fixing method. The belt fixing method can form a wide nip portion without increasing the size of the device, as compared with the roller fixing method. Therefore, the belt fixing method can shorten the waiting time during the fixing process, reduce the size of the device, and perform the fixing process at increased speed.

U.S. Pat. No. 6,671,488 discloses a fixing device which employs a film heating method as the belt fixing method. This fixing device sandwiches a heat-resistant resin film (hereinafter referred to as "fixing film") as a heating member by a ceramic heater (heating pair) and a pressing roller (pressurizing member) to form a nip portion (hereinafter referred to as "fixing nip portion"). The printing media carrying the toner image is sandwiched and transported together with the fixing film at the fixing nip portion, thus, the heat of the ceramic heater is given to the toner image via the fixing film. Further, the fused toner image and the printing media are pressurized at the fixing nip portion to thereby fix the toner image on the printing media.

The fixing performance of the fixing device is affected by the environmental condition. For example, in the fixing device, the optimum fixing temperature for heating and melting the toner image changes as the environmental state changes. Therefore, in an electrophotographic type image forming apparatus having the fixing device, an environment sensor which detects environmental information such as temperature and humidity is provided. The environment sensor is provided in the image forming apparatus and includes an environment detection element such as a temperature detection element and a humidity detection element. The analog signal (detection result) output from the environment detection element is A/D converted and processed as environment data such as temperature data and humidity data. The processing result (for example, the environmental temperature) is used in a feedback process for determining the optimum fixing temperature (U.S. Pat. No. 5,138,379, Japanese Patent Application Laid-open No. 4-104284).

As to an image forming apparatus which is installed in a humid area, a heater (environmental heater) may be installed in its housing for preventing moisture absorption of the printing media and dew condensation on the photoconductor. The environmental temperature detected by the environment sensor becomes higher than the actual environmental temperature due to the heat generated by the environmental heater. In a case where the environment sensor is arranged at a position away from the fixing device, there may be a difference between the environmental temperature detected by the environment sensor and the environmental temperature around the fixing device. This makes it difficult to determine the optimum fixing temperature w % ben controlling the fixing temperature based on the detection result of the environment sensor. Therefore, in view of the above, at least one object of the present disclosure is to suppress the influence of the heater to appropriately control the fixing temperature.

SUMMARY OF THE INVENTION

An image forming apparatus of the present disclosure includes: a first sensor configured to detect a temperature; an image forming unit configured to form an image; a sheet container configured to contain sheets; a conveyance roller configured to convey a sheet from the sheet container; a transfer unit configured to transfer the image on the sheet conveyed by the conveyance roller; a fixing unit configured to fix the image on the sheet by heating the image on the sheet, the fixing unit having a fixing heater; a second sensor configured to detect a temperature of the fixing unit; a sheet container heater configured to heat the sheet in the sheet container, wherein the sheet container heater is provided at a position where a distance from the first sensor to the sheet container heater is closer than a distance from the fixing unit to the sheet container heater; a switch provided in a supply line which supplies an electric power to the sheet container heater; and a controller configured to control a power supply to the fixing heater based on a detection result of the first sensor, a detection result of the second sensor, and a state of the switch, wherein the controller is configured to control whether or not to supply the electric power to the sheet container heater in a case where the switch is in a first state, and wherein the electric power is not supplied to the sheet container heater in a case where the switch is in a second state.

Further features of the present invention will become apparent from the following description of exemplary embodiments (with reference to the attached drawings).

DESCRIPTION OF THE EMBODIMENTS

At least one embodiment of the present invention is described below in detail with reference to the accompanying drawings.

Image Forming Apparatus

Figure 1:
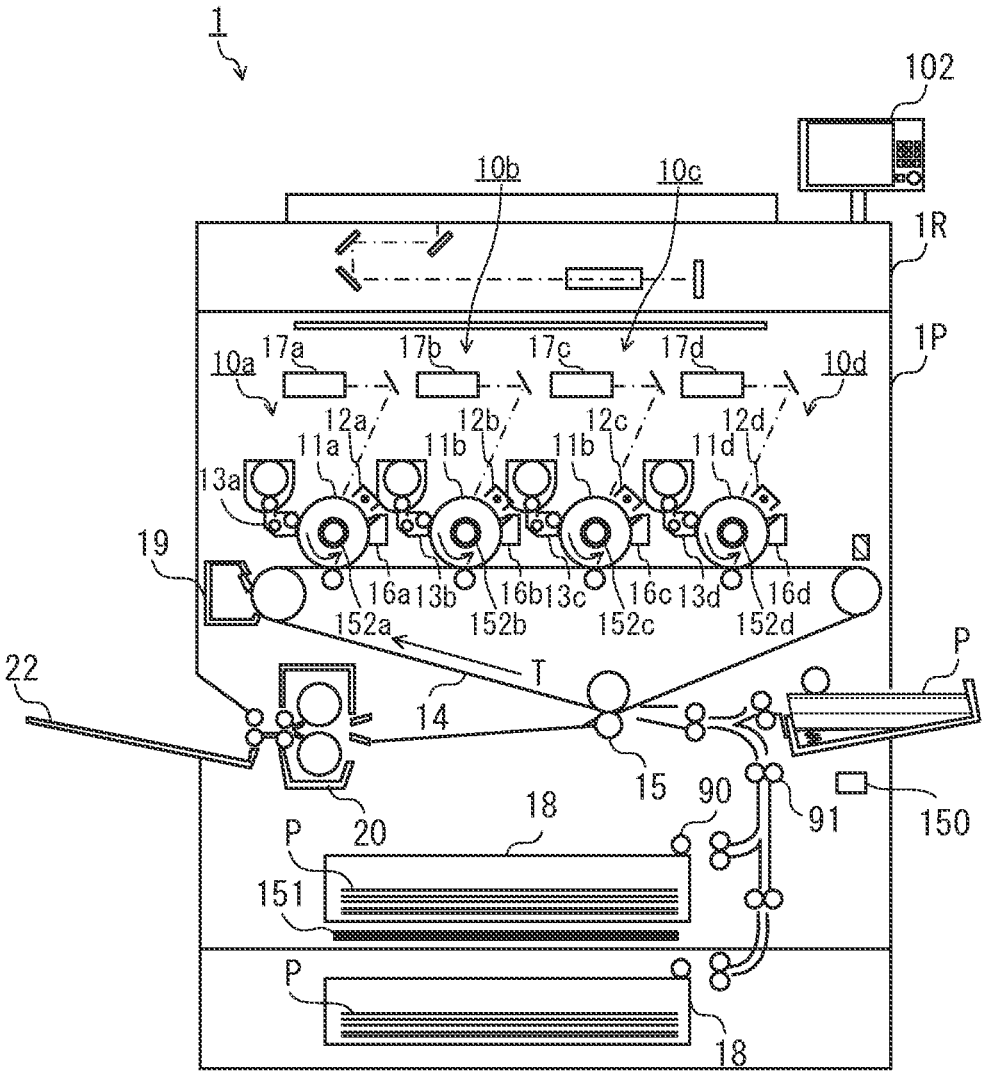
FIG. 1 is a schematic sectional view of an image forming apparatus.

FIG. 1 is a sectional view illustrating an example of an image forming apparatus of the present embodiment. The image forming apparatus 1 transfers the toner image formed by using electrophotographic process technology onto printing media P, such as a sheet to heat and fix the toner image transferred onto the printing media P. The image forming apparatus 1 of the present embodiment includes an operation unit 102, an image reading unit 1R, and an image output unit 1P. The image reading unit 1R optically reads the image of an original to convert the read original image into an electric signal (hereinafter referred to as "image data") and transmits the image data to the image output unit 1P. The image output unit 1P performs an image forming process based on the image data received from the image reading unit 1R to form an image on the printing media P. As described above, the image forming apparatus 1 has a copying ability for copying the original using the image reading unit 1R. Further, the image forming apparatus 1 has a print function of forming an image on the printing media P according to the image data stored in a portable storage medium, and a print job obtained from an external device via a network or the like.

As a physical key for allowing a user to make various inputs and settings, the operation unit 102 includes a numeric keypad for inputting the number of images to be formed and a copy magnification, etc., a start button for starting image forming, and a setting button for setting a paper type and a size of the printing media P. Further, the operation unit 102 includes a display capable of displaying guidance for assisting various operations of the image forming apparatus 1. On the display, an image, or a message for notifying the user of the status of the image forming apparatus 1 is displayed. Through the display, the user is notified, for example, that the image forming apparatus 1 is forming an image and that an error such as a jam has occurred in the image forming apparatus 1.

The image output unit 1P includes four image forming units 10*a*, 10*b*, 10*c*, and 10*d*, an intermediate transfer belt 14, a sheet cassette 18, and a detachable fixing device 20. Each of the image forming unit 10*a*. 10*b*, 10*c*, and 10*d* has the same configuration and operates in the same manner except that the colors of the images formed are different. The image forming unit 10*a* forms a yellow toner image. The image forming unit 10*b* forms a magenta toner image. The image forming unit 10*c* forms a cyan toner image. The image forming unit 10*d* forms a black toner image. The alphabet a, b, c, and d at the end of the reference numerals correspond to the colors to be formed. In the following description, when it is not necessary to distinguish the colors, a, b, c, and d at the end of the reference numerals are omitted.

The image forming unit 10 includes a photosensitive drum 11, a charger 12, a developing device 13, a drum cleaner 16, and a laser scanner unit 17. The photosensitive drum 11 has a built-in drum heater 152. The drum heater 152 is an environmental heater which raises a temperature inside the housing of the image output unit 1P to prevent a dew condensation on the photosensitive drum 11.

The photosensitive drum 11 is a photosensitive member having a photosensitive layer on its surface. The charger 12 uniformly charges the surface of the photosensitive drum 11. The laser scanner unit 17 irradiates the charged surface of the photosensitive drum 11 with light which is modulated according to the image data through a mirror. As a result, an electrostatic latent image of the corresponding color component is formed on the surface of the photosensitive drum 11. The developing device 13 develops the electrostatic latent image on the photosensitive drum 11 using the toner of the corresponding color accumulated inside. As a result, the toner image of the corresponding color component is formed in the photosensitive drum 11. The image forming unit 10 functions as an image forming means for forming the toner image.

The intermediate transfer belt 14 is an endless intermediate transfer member stretched and supported by a plurality of rollers. The intermediate transfer belt 14 is moved in a direction of an arrow T by the rotational drive of each roller. A belt cleaner 19 is provided in the vicinity of the intermediate transfer belt 14. The toner images of the color components formed on the respective photosensitive drum 11*a*, 11*b*, 11*c*, and 11*d* are transferred on the intermediate transfer belt 14 in an overlapping fashion. As a result, a full-color toner image is formed on the intermediate transfer belt 14. The remaining toner, which is not transferred from the photosensitive drum 11 to the intermediate transfer belt 14, on the photosensitive drum 11 is removed by the drum cleaner 16.

The sheet cassette 18 functions as a sheet container for accommodating the printing media P. The printing media P is, for example, a sheet-like paper material having a size such as A4 size, letter size, A5 size, A4R size, or the like. A cassette heater 151 is provided below the sheet cassette 18. The cassette heater 151 is the environmental heater, which raises the temperature inside a housing of the image output unit 1P to suppress the moisture absorption of the printing media P.

The printing media P is fed from the sheet cassette 18 by the pickup roller 90 and is conveyed along the conveying path by the conveyance roller 91. The printing media P is conveyed to the transfer roller 15 by adjusting the timing so as to contact with the toner image formed on the intermediate transfer belt 14. The transfer roller 15 transfers the toner image on the intermediate transfer belt 14 on the printing media P by applying a transfer voltage in a state in which the toner image on the intermediate transfer belt 14 and the printing media P are in contact with each other. The remaining toner, which is not transferred from the intermediate transfer belt 14 to the printing media P, on the intermediate transfer belt 14 is removed by the belt cleaner 19.

The printing media P on which the full-color toner image has been transferred is conveyed to the fixing device 20, which is provided on the downstream side of the transfer roller 15 and separated as a unit. The toner image on the printing media P is melted by heat in the fixing device 20 and fixed to the printing media P by pressure. The printing media P on which the toner image is fixed is discharged to a discharge tray 22 of the image forming apparatus by a discharge roller.

The image forming apparatus 1 of the present disclosure has an environment sensor 150 (first sensor) for detecting temperature and humidity (environmental information). The environment sensor 150 is provided in the image forming apparatus 1 away from the fixing device 20 having a heat source, and the environment sensor 150 includes an environment detection element such as a temperature detection element and a humidity detection element. The target value of the fixing temperature of the fixing device 20 is controlled according to a detection result of the environmental temperature by the environment sensor 150.

Fixing Device

Figure 2:
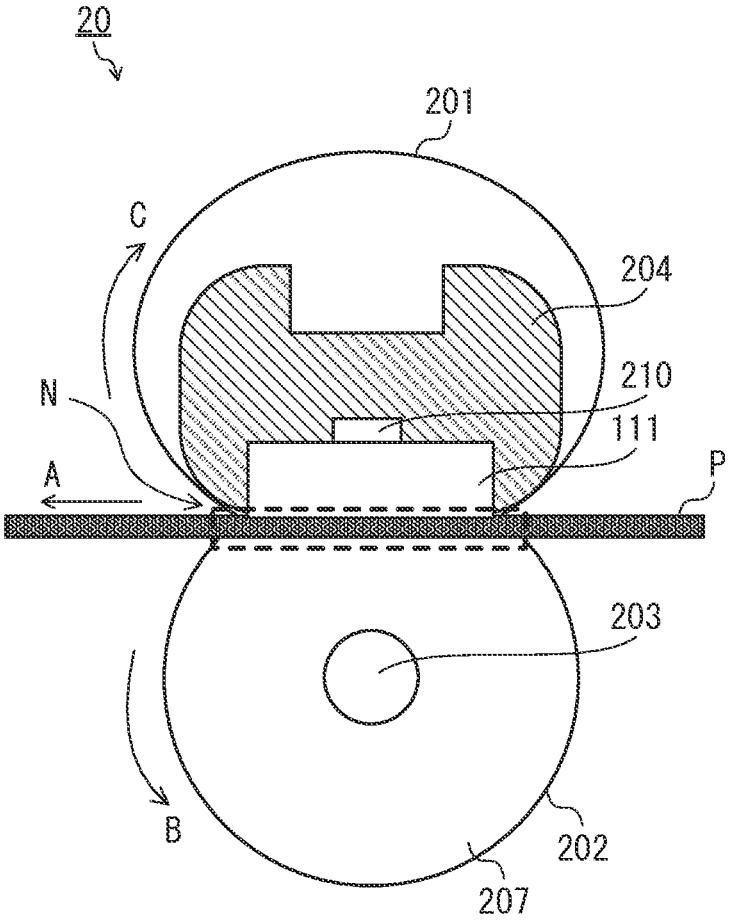
FIG. 2 is an explanatory configuration diagram of a fixing device.

FIG. 2 is a configuration diagram of the fixing device 20. The fixing device 20 includes a fixing heater 111, a fixing film 201, a pressing roller 202, a stay 204, and a thermistor 210 (second sensor). The fixing heater 111 is a heating element which functions as a heating means. The thermistor 210 is an example of a temperature sensor which detects the temperature of the fixing heater 111.

The fixing film 201 is a cylindrical heat-resistant film material having a thickness of 40 μm to 100 μm. The pressing roller 202 is a roller on which a heat-resistant elastic layer 207, which is made of silicon rubber, for example, on an outer circumference of the core metal 203. The stay 204 is a member having heat resistance property and heat insulating property and presses the fixing heater 111 toward the pressing roller 202 side via the fixing film 201. By pressing the fixing film 201 toward the pressing roller 202, a fixing nip portion N (area surrounded by a broken line in FIG. 2) is formed. The printing media P on which the toner image has been transferred passes through the fixing nip portion N. The fixing device 20 heats and melts the toner image with the fixing heater 111 at the fixing nip portion N and pressurizes the printing media P with the pressing roller 202 to fix the toner image on the printing media P.

The pressing roller 202 rotates in the direction of arrow B. As a result, the fixing film 201 is driven and rotated by the pressing roller 202 in the direction of arrow C. The printing media P is sandwiched at the fixing nip portion N and is conveyed in the arrow direction A, by rotating the pressing roller 202.

Control Unit

Figure 3:
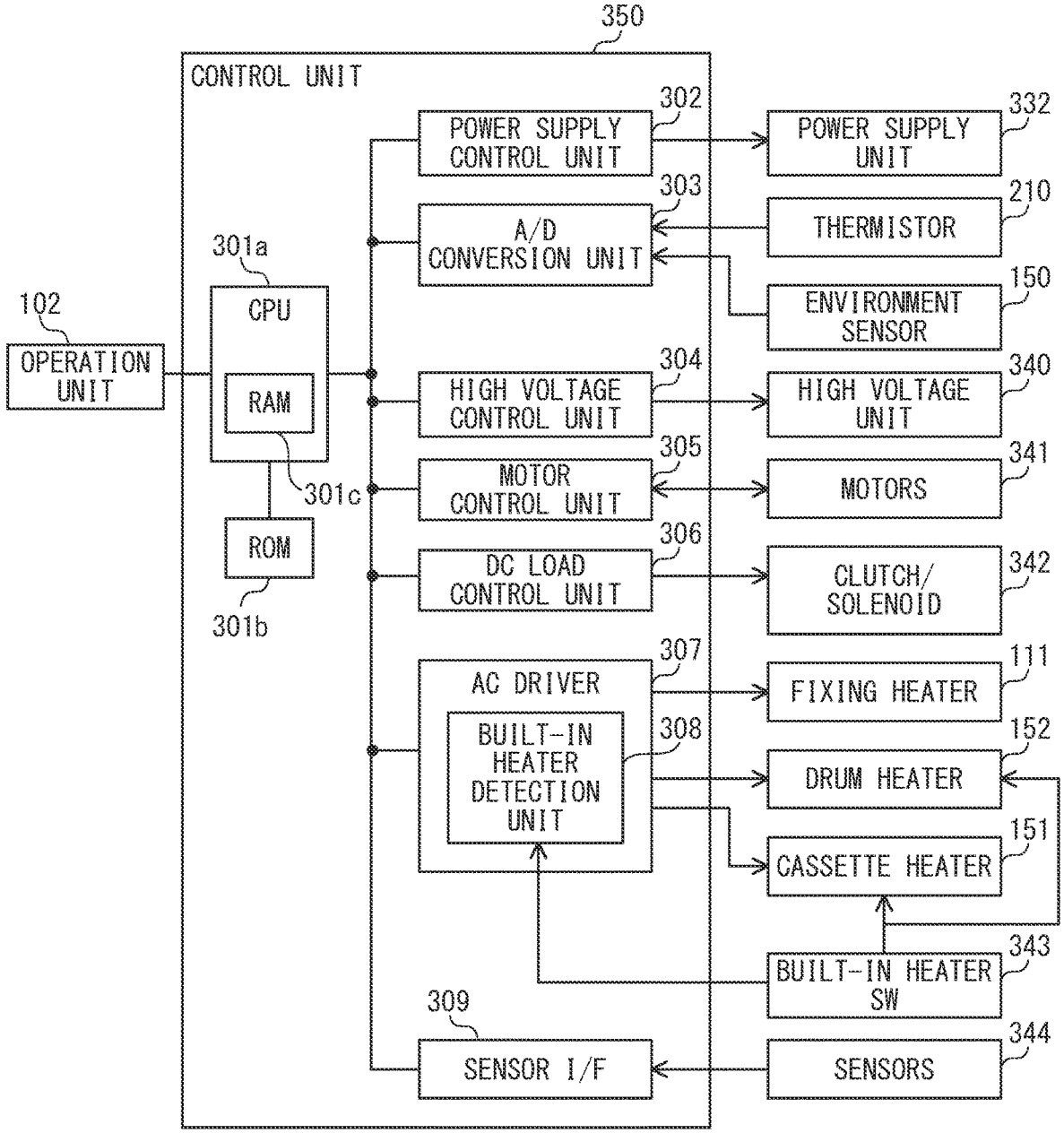
FIG. 3 is an exemplary diagram of a control unit.

FIG. 3 is an explanatory configuration diagram of a control unit which comprehensively controls the operation of the image forming apparatus 1. A control unit 350 is comprised of one board and is provided in a housing of the image forming apparatus 1. The control unit 350 drives each load (motors 341 and clutch/solenoid 342) in the image forming apparatus 1, collects and analyzes detection results of the sensors 344, and exchanges data with the operation unit 102.

The control unit 350 is connected to a power supply unit 332 and is configured to control the operation of the power supply unit 332. The power supply unit 332 generates a predetermined voltage from the electric power supplied from a commercial power source and supplies it to each part in the image forming apparatus 1. The control unit 350 is connected to a thermistor 210, an environment sensor 150, and sensors 344 such as a photo interrupter and a micro switch. The sensors 344 are arranged in various places in the image forming apparatus, and detect the operation of each part in the image forming apparatus, conveyance states of the printing media P, and the like. The control unit 350 obtains the detection results of the thermistor 210, the environment sensor 150, and the sensors 344, and controls the operation of each part in the image forming apparatus 1 according to the detection results.

The control unit 350 is connected to a high voltage unit 340 to control the operation of the same. The high voltage unit 340 is a unit including an electric wire and a wire spring for applying a high voltage. The high voltage unit 340 outputs a transfer voltage used when transferring the toner image and a charging bias for charging the surface of the photosensitive drum 11. The charger 12 charges the surface of the photosensitive drum 11 according to the charging bias. The control unit 350 is connected to DC loads such as motors 341 and a clutch/solenoid 342 arranged in various places in the image forming apparatus 1 and is configured to control the operation of these DC loads. The DC loads are used for controlling the operation of each part in the image forming apparatus 1. The motors 341 are drive sources for conveying the printing media P, drive sources for rotationally driving the photosensitive drum 11, drive sources for rotating the intermediate transfer belt 14, drive sources for the pressing roller 202 of the fixing device 20, and the like.

The control unit 350 is connected to the fixing heater 111 to adjust a fixing temperature of the fixing heater 111 based on a detected temperature detected by the thermistor 210 and the detection result by the environment sensor 150. The fixing heater 11 is, for example, a ceramic heater. The control unit 350 is connected to the drum heater 152, the cassette heater 151, and a built-in heater switch (SW) 343. The control unit 350 controls the operation of the drum heater 152 to prevent dew condensation on the photosensitive drum 11. The control unit 350 controls the operation of the cassette heater 151 to prevent the printing media P in the sheet cassette 18 from absorbing moisture. Whether or not to control the drum heater 152 and the cassette heater 151 is determined according to a state of the built-in heater SW 343. For example, when the built-in heater SW 343 is on, the drum heater 152 and the cassette heater 151 can be controlled by the control unit 350.

The control unit 350 has the following configuration for controlling the operation of these connected components. The control unit 350 includes a CPU (Central Processing Unit) 301*a* and a ROM (Read Only Memory) 301*b*. The CPU 301*a* controls the image forming process by the image forming apparatus 1 by executing the computer program stored in the ROM 301*b*. The CPU 301*a* has a RAM (Random Access Memory) 301*c*. The RAM 301*c* stores data which can be rewritten when the process is executed. In the RAM 301*c*, for example, high voltage set value set in the high voltage control unit 304 and input information such as a image formation command information from the operation unit 102 are stored. The operation unit 102 inputs information such as a density setting value and a copy magnification set by the user in the control unit 350. The operation unit 102 represents to the user the state of the image forming apparatus 1, for example, information on the number of images formed, information on whether or not an image is being formed, an occurrence of a jam and its location, and the like.

The control unit 350 includes a power supply control unit 302 to control the power supply unit 332. The power supply control unit 302 controls the operation of the power supply unit 332 in response to an instruction from the CPU 301*a*. The control unit 350 includes an A/D conversion unit 303 for obtaining detection results from the thermistor 210 and the environment sensor 150. The A/D conversion unit 303 converts the detection results obtained from the thermistor 210 and the environment sensor 150 into a digital signal and transmits it to the CPU 301*a*. The CPU 301*a* detects the temperature of the fixing heater 111 from the detection result of the thermistor 210. The CPU 301*a* detects the environmental temperature in the housing of the image forming apparatus 1 from the detection result of the environment sensor 150. The control unit 350 includes a high voltage control unit 304 for controlling the high voltage unit 340. The high voltage control unit 304 controls the operation of the high voltage unit 340 in response to the instruction from the CPU 301*a*.

The control unit 350 includes a motor control unit 305 for controlling the motors 341. The motor control unit 305 controls the operation of the motors 341 in response to the instruction from the CPU 301*a*. The control unit 350 includes a DC load control unit 306 for controlling the clutch/solenoid 342. The DC load control unit 306 controls the operation of the clutch/solenoid 342 in response to the instruction from the CPU 301*a*.

The control unit 350 includes an AC driver 307 for controlling the fixing heater 111, the drum heater 152, and the cassette heater 151. The AC driver 307 includes a built-in heater detection unit 308. The CPU 301*a* instructs the AC driver 307 to control the fixing heater 111 based on the detection result (detection value) obtained from the thermistor 210 and the environment sensor 150. The AC driver 307 controls the operation of the fixing heater 111 in response to the instruction from the CPU 301*a* to adjust the temperature during the fixing process by the fixing device 20.

The AC driver 307 confirms a state of the built-in heater SW 343 by the built-in heater detection unit 308. The CPU 301*a* can control the operation of the drum heater 152 and the cassette heater 151 when the built-in heater SW 343 is on. The AC driver 307 controls operations of the drum heater 152 and the cassette heater 151 in response to an instruction from the CPU 301*a*.

The control unit 350 includes a sensor interface (I/F) 309 for obtaining detection results from the sensors 344. The sensor I/F 309 transmits the detection results obtained from the sensors 344 to the CPU 301*a*. The CPU 301*a* monitors the operations of the motors 341 and the clutch/solenoid 342 based on the detection results of the sensors 344 and controls the operations of the motors 341 and the clutch/solenoid 342.

Fixing Heater Control

Figure 4:
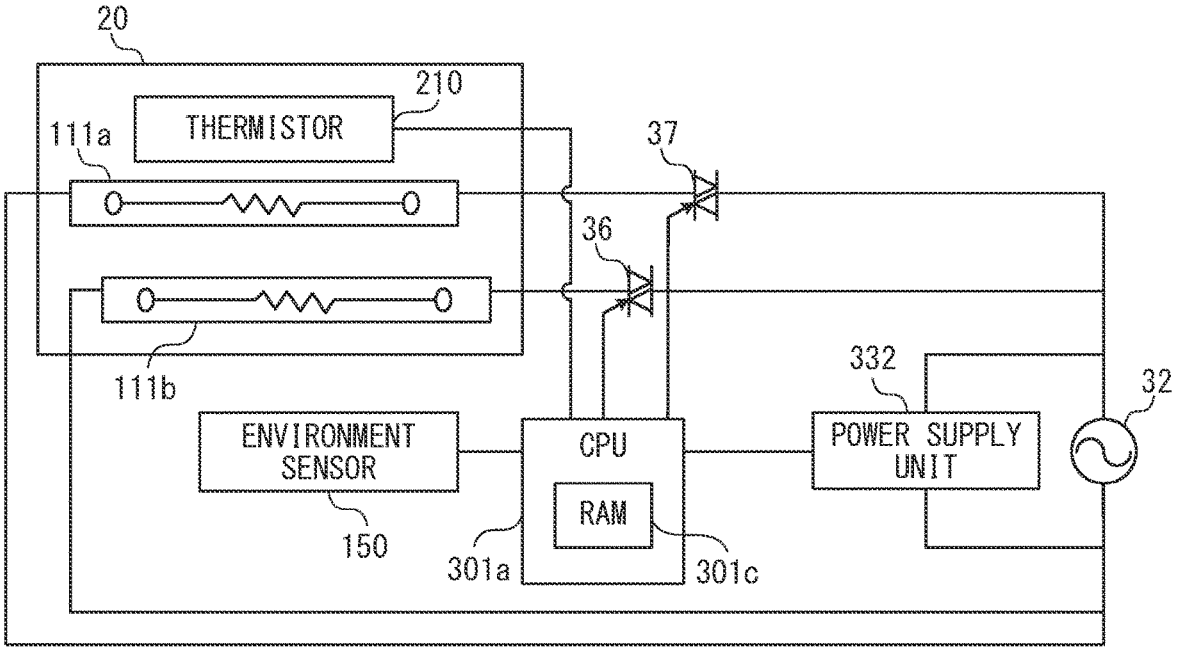
FIG. 4 is an explanatory diagram of a power supply control for a fixing heater.

FIG. 4 is an explanatory diagram of power supply control to the fixing heater 111 of the fixing device 20. FIG. 4 represents a case where the fixing device 20 includes two fixing heaters 111*a* and 111*b*. Electric power is supplied to the fixing heaters 111*a* and 111*b* from the commercial power supply 32. The commercial power supply 32 is an AC power supply. A semiconductor switch 37 is provided on the power supply line from the commercial power supply 32 to the fixing heater 111*a*. A semiconductor switch 36 is provided in the power supply line from the commercial power supply 32 to the fixing heater 111*b*. The thermistor 210 is provided in the vicinity of the fixing heaters 111*a* and 111*b*.

The power supply unit 332 generates a DC Voltage having predetermined voltage values (for example, 24V or 3.3V) from the AC power supplied from the commercial power supply 32 and supplies it to each part in the image forming apparatus 1 such as CPU 301*a*. The CPU 301*a* performs a continuity control of the semiconductor switches 36 and 37 by the AC driver 307 (see FIG. 3) based on the detection results of the environment sensor 150 and the thermistor 210. Information indicating the relationship between an environmental temperature and an amount of electric power supplied to the fixing heater 111 is stored in the ROM 301*b*. The CPU 301*a* calculates an electric power to be supplied to the fixing heaters 111*a* and 111*b* based on the environmental temperature detected by the environment sensor 150, the detected temperature of the fixing device 20 detected by the thermistor 210, and the information stored in the ROM 301*b*. The CPU 301*a* controls the continuity of the semiconductor switches 36 and 37 according to the calculated electric power.

The semiconductor switches 36 and 37 are gate-controlled switches, which are realized by a bidirectional thyristor, for example. The semiconductor switches 36 and 37 supply the electric power from the commercial power supply 32 to the fixing heaters 111*a* and 111*b* by controlled to be in a conductive state by the CPU 301*a*.

Built-In Heater Control

Figure 5:
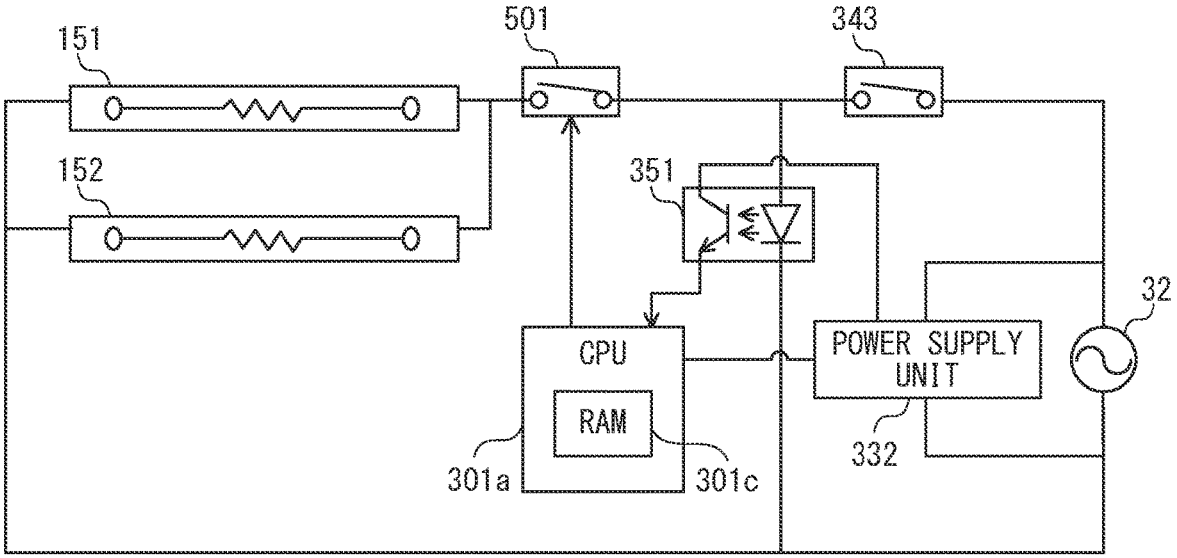
FIG. 5 is an explanatory diagram of an electric power supply to a built-in heater (environmental heater).

FIG. 5 is an explanatory diagram of the power supply to the built-in heaters (environmental heaters) such as a cassette heater 151, a drum heater 152, and the like. A built-in heater SW 343 and a normally closed relay 501 are provided in series on the power supply line from the commercial power supply 32 to the cassette heater 151 and the drum heater 152. The normally closed relay 501 is normally closed, and is controlled to open and close by the CPU 301*a*. A photocoupler 351 is provided between the built-in heater SW 343 and the normally closed relay 501 in order to detect an ON/OFF state of the built-in heater SW 343.

From the outside of the image forming apparatus 1, a user or a service engineer who maintains the image forming apparatus 1 performs an ON/OFF control of the built-in heater SW 343. For example, when the image forming apparatus 1 is provided in a high humidity environment, the service engineer turns on the built-in heater SW 343 in order to prevent the printing media P stored in the sheet cassette 18 from absorbing moisture. As a result, the cassette heater 151 is energized. The cassette heater 151 generates heat when energized to dehumidify.

The photocoupler 351 notifies the CPU 301*a* of the ON/OFF state of the built-in heater SW 343. In the photocoupler 351, an electric current flows through an internal photodiode when the built-in heater SW 343 is in the ON state. This causes the photodiode to emit light. Light emitted from the photodiode is received by the phototransistor inside the photocoupler 351. The phototransistor conducts by receiving light and transmits the voltage output from the power supply unit 332 to the CPU 301*a*. The voltage output from the power supply unit 332 is information indicating energization information to the cassette heater 151 and the drum heater 152 (built-in heater). The CPU 301*a* can detect the ON state of the built-in heater SW 343 by receiving the voltage output from the power supply unit 332 via the photocoupler 351. When the voltage output from the power supply unit 332 is not received via the photocoupler 351, the CPU 301*a* detects that the built-in heater SW 343 is in the OFF state.

The opening and closing of the normally closed relay 501 are controlled by the CPU 301*a*. The normally closed relay 501 is in a closed state when the CPU 301*a* is not operating, and the normally closed relay 501 supplies power from the commercial power supply 32 to the cassette heater 151. While the image is being formed by the image forming apparatus 1, the CPU 301*a* controls the normally closed relay 501 in an open state by the AC driver 307 (see FIG. 3) to suppress power consumption to thereby cut off the power supply to the cassette heater 151.

Fixing Heater Control According to Environmental Conditions

Figure 6:
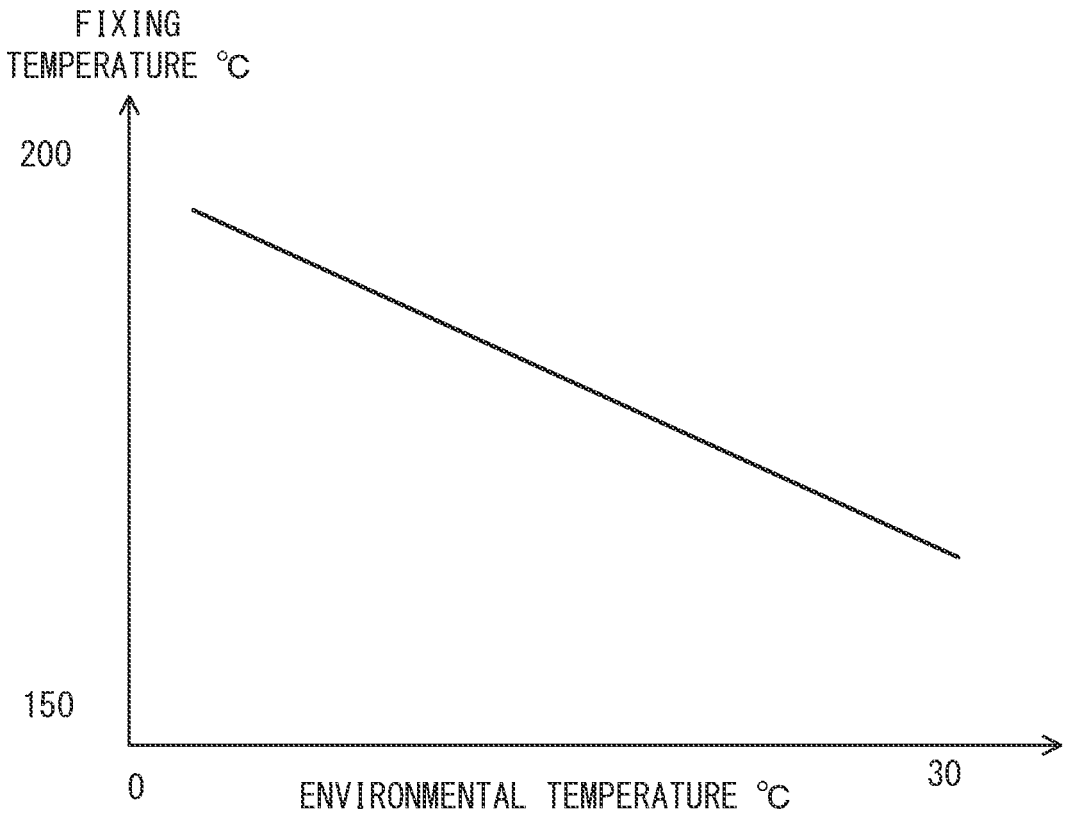
FIG. 6 is an explanatory diagram of relation between an environmental temperature and a fixing temperature.

An optimum value of the fixing temperature when the fixing device 20 performs the fixing process changes according to the environmental temperature around the fixing device 20. FIG. 6 is an explanatory diagram of relationship between the environmental temperature and the fixing temperature. The horizontal axis represents the environmental temperature, and the vertical axis represents the optimum fixing temperature during the fixing process.

As to the fixing device 20, its internal atmospheric temperature changes due to the environmental temperature, thus the fixing performance changes. In general, the lower the environmental temperature, the cooler the fixing film 201 is during rotation, thus the temperature is lowered at the fixing nip portion N. Therefore, the toner is less likely to melt at the fixing nip portion N. On the contrary, the higher the environmental temperature, the more difficult it is for the fixing film 201 to be cooled during rotation. Therefore, the temperature at the fixing nip portion N is maintained high. Thus, the toner at the fixing nip portion N is easy to melt. Resultingly, there is a tendency that the higher the environmental temperature around the fixing device 20, the lower the optimum fixing temperature for the fixing process.

The CPU 301*a* sets a target fixing temperature according to the detection value (the environmental temperature) of the environment sensor 150. Based on the detection temperature of the fixing device 20 (fixing heater 111) detected by the thermistor 210 and a target fixing temperature, the CPU 301*a* determines the content of the energization control (power amount to be supplied, etc.) to the fixing heater 111 to thereby control the power supply from the commercial power supply 32 to the fixing heater 111. In order for the CPU 301*a* to set a target fixing temperature from the environment temperature, a fixing temperature table representing the relationship between the environment temperature and the fixing temperature as shown in FIG. 6 is previously stored in the ROM 301*b*.

Figure 7:
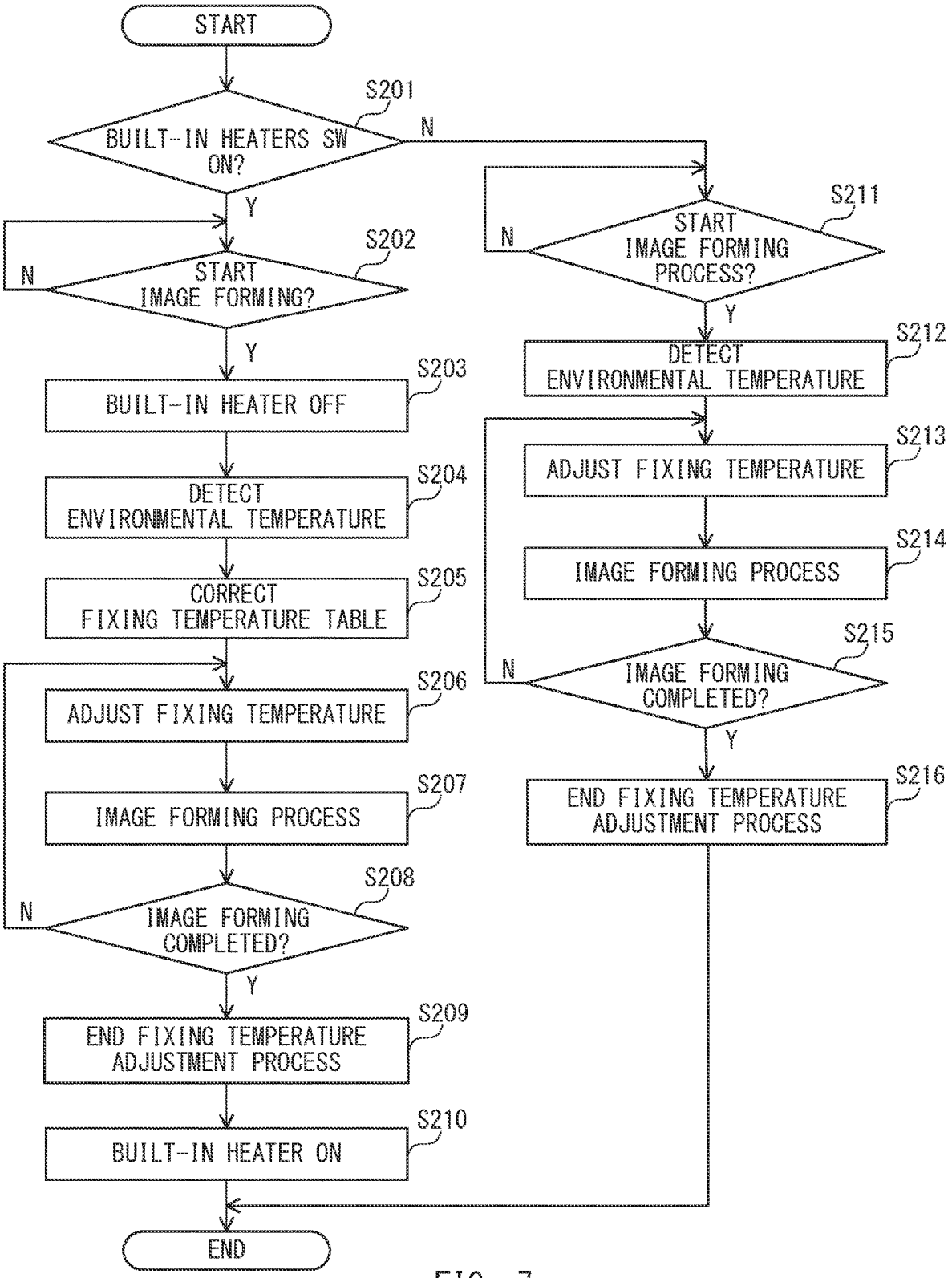
FIG. 7 is a flow chart representing a control process of the fixing heater.

FIG. 7 is a flowchart representing the control process of the fixing heater 111. This process is based on the energized state of the built-in heaters such as the cassette heater 151 and the drum heater 152, the environmental temperature detected by the environment sensor 150, and the temperature detected by the thermistor 210. This process is started when the image forming apparatus 1 is powered on or resumed from a sleep state.

The CPU 301*a* determines whether or not the built-in heater SW 343 is in the ON state (STEP S201). The CPU 301*a* makes this determination based on whether or not the voltage output from the power supply unit 332 is received via the photocoupler 351. The CPU 301*a* determines whether or not the built-in heater is generating heat depending on whether or not the built-in heater SW 343 is in the ON state.

When the built-in heater SW 343 is in the ON state (STEP S201: Y), the CPU 301*a* determines whether or not to start the image forming process (STEP S202). The CPU 301*a* makes this determination based on whether or not an image formation instruction has been received from the operation unit 102 or the external device. When the built-in heater SW 343 is in the ON state, the CPU 301*a* supplies power to the built-in heater in a standby mode. When starting the image forming process (STEP S202: Y), to reduce the power consumption other than the power required for image formation, the CPU 301*a* cuts off (turns off) the power supply to the built-in heaters such as the cassette heater 151 and the drum heater 152 (STEP S203). The CPU 301*a* cuts off the power supply to the built-in heater by opening the normally closed relay 501. Further, the CPU 301*a* detects the environmental temperature based on the detection result of the environment sensor 150 (STEP S204).

Since the built-in heater SW 343 is in the ON state, the environmental temperature detected by the environment sensor 150 increases due to the influence of the heat from the cassette heater 151 and the drum heater 152. The cassette heater 151 and the drum heater 152 are provided for the purpose of preventing dew condensation and moisture absorption, however, due to this, the temperature inside the housing of the image forming apparatus 1 is increased. Due to the heat caused by these heaters, the environmental temperature detected by the environment sensor 150 increases. The CPU 301*a* reads out and corrects, considering the increase in the environmental temperature, a fixing temperature table of the fixing device 20 previously stored in the ROM 301*b* in order to calculate the amount of electric power supplied to the fixing heater 111 (STEP S205).

Figure 8:
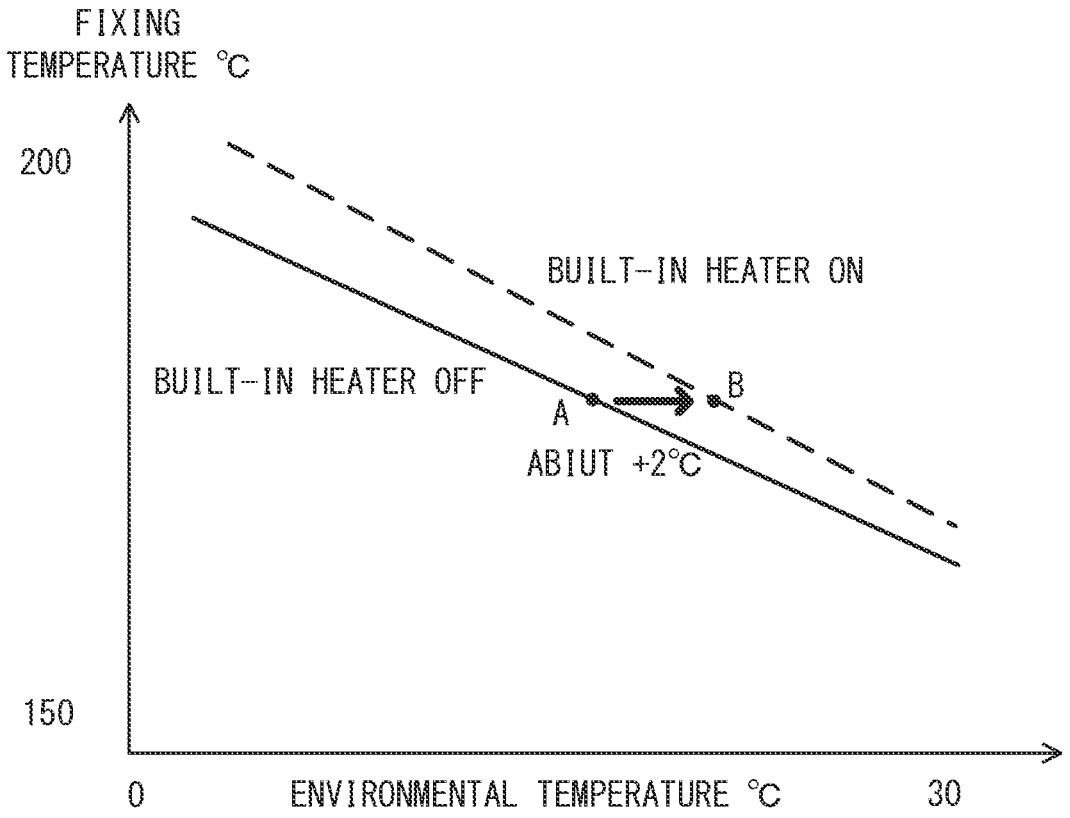
FIG. 8 is an explanatory diagram of relation between the environmental temperature and the fixing temperature.

The increase in the detection result of the environmental temperature due to the influence of the heat applied to the environment sensor 150 will be described with reference to FIG. 8. FIG. 8 is an explanatory diagram of the relationship between the environmental temperature and the fixing temperature. The horizontal axis represents the environmental temperature, and the vertical axis represents the optimum fixing temperature during the fixing process performed by the fixing heater 111.

For example, the environmental temperature detected by the environment sensor 150 when the built-in heater SW 343 is in the OFF state is set to A° C. The environmental temperature detected by the environment sensor 150 when the built-in heater SW 343 is in the ON state in the same environment becomes B° C., which is higher than A° C. by a predetermined temperature (in this case, about 2° C.). As to the deviation of the environmental temperature detected by the environment sensor 150 caused by the change in the state of the built-in heater SW 343, it tends to be slightly smaller as the environmental temperature increases. However, the deviation is in the range of around 2° C.

The fixing device 20 is configured to be a separated unit, and is arranged at a position away from the environment sensor 150. Therefore, the fixing device 20 is not easily affected by the heat generated by the built-in heaters such as the cassette heater 151 and the drum heater 152 even when the built-in heater SW 343 is in the ON state. As a result, when the built-in heater SW 343 is in the ON state, a predetermined temperature (about 2° C.) difference occurs between the environmental temperature detected by the environment sensor 150 and the environmental temperature around the fixing device 20. In FIG. 8, the solid line shows the relationship between the environmental temperature around the fixing device 20 and the fixing temperature, and the broken line shows the relationship between the environmental temperature detected by the environment sensor 150 and the fixing temperature. In order to suppress the influence of the difference between the environmental temperature detected by the environment sensor 150 and the environmental temperature around the fixing device 20, the correction process of STEP S205 is performed. Specifically, the CPU 301*a* corrects the fixing temperature table (broken line) to the fixing temperature table (solid line). The fixing temperature table (broken line) shows the relationship between the environmental temperature detected by the environment sensor 150 and the fixing temperature, and the fixing temperature table (solid line) shows the relationship between the environmental temperature around the fixing device 20 and the fixing temperature.

After the correction of the fixing temperature table, the CPU 301*a* adjusts the fixing temperature using the corrected fixing temperature table (STEP S206). The CPU 301*a* determines a target fixing temperature based on the corrected fixing temperature table. That is, the CPU 301*a* determines the fixing temperature according to the temperature decreased by a predetermined temperature from the environmental temperature detected by the environment sensor 150. The CPU 301*a* calculates the amount of electric power supplied to the fixing heaters 111*a* and 111*b* based on the target fixing temperature and the detected temperature of the fixing device 20 detected by the thermistor 210. The CPU 301*a* controls the semiconductor switches 36 and 37 to supply the calculated electric power to the fixing heaters 111*a* and 111*b*. Thus, the electric power supplied to the fixing heaters 111*a* and 111*b* is adjusted so that the temperature of the fixing device 20 becomes the target fixing temperature.

The CPU 301*a* performs an image forming process while adjusting the fixing temperature (STEP S207). The CPU 301*a* repeatedly performs a fixing temperature adjustment process until the image forming process is completed (STEP S208: N). When the image forming is completed (STEP S208: Y), the CPU 301*a* ends the fixing temperature adjustment process for the fixing device 20 (STEP S209). The CPU 301*a* restarts (turns on) the power supply to the built-in heaters such as the cassette heater 151 and the drum heater 152 (STEP S210). The CPU 301*a* restarts the power supply to the built-in heater by closing the normally closed relay 501. When the built-in heater SW 343 is in the ON state, the fixing temperature is adjusted as described in the above processing.

When the built-in heater SW 343 is in the OFF state (STEP S201: Y), the CPU 301*a* determines whether or not to start the image forming process, as in the process of STEP S202 (STEP S211). When starting the image forming process (STEP S211: Y), the CPU 301*a* detects the environmental temperature based on the detection result of the environment sensor 150 (STEP S212), as in the process of STEP S204.

The CPU 301*a* adjusts the fixing temperature using the fixing temperature table of the fixing device 20 previously stored in the ROM 301*b* based on the detected environmental temperature (STEP S213). Since the built-in heater SW 343 is in the OFF state, the detected environmental temperature is not affected by the built-in heater. Therefore, the CPU 301*a* does not need to correct the fixing temperature table. The CPU 301*a* determines the target fixing temperature based on the uncorrected fixing temperature table. The CPU 301*a* calculates the amount of electric power supplied to the fixing heaters 111*a* and 111*b* based on the target fixing temperature and the detected temperature of the fixing device 20 detected by the thermistor 210. The CPU 301*a* controls the semiconductor switches 36 and 37 to supply the calculated electric power to the fixing heaters 111*a* and 111*b*. As a result, the electric power supplied to the fixing heaters 111*a* and 111*b* is adjusted so that the temperature of the fixing device 20 becomes the target fixing temperature.

The CPU 301*a* performs an image forming process while adjusting the fixing temperature (STEP S214). The CPU 301*a* repeatedly adjusts the fixing temperature until the image forming process is completed (STEP S215: N). When the image forming is completed (STEP S215: Y), the CPU 301*a* ends the fixing temperature adjustment process for the fixing device 20 (STEP S216). When the built-in heater SW 343 is in the OFF state, the fixing temperature is adjusted by the above processing.

The image forming apparatus 1 described in the above embodiment is configured to correct the fixing temperature table when the energized state of the built-in heater is in the ON state. However, the image forming apparatus 1 may have a plurality of fixing temperature tables corresponding to the energized state, for example. The CPU 301*a* determines the fixing temperature with reference to a Table A as the fixing temperature table when the energized state of the built-in heater is the ON state, and determines the fixing temperature with reference to a Table B as the fixing temperature table when the energized state of the built-in heater is the OFF state. Table A and Table B function as different determinants for determining the fixing temperature.

As described above, the image forming apparatus 1 of the present embodiment determines whether or not the power is supplied to the environmental heaters (built-in heaters such as the cassette heater 151 and the drum heater 152) to thereby suppress the mismatch of environmental information such as the environmental temperature and the like. As a result, the image forming apparatus 1 can suppress the influence of the environmental heater, and perform the fixing process by the fixing device 20 at the optimum fixing temperature. Therefore, the image forming apparatus 1 can form an image with better image quality on the printing media P as compared to the conventional method.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-212661, filed Dec. 22, 2020, which is hereby incorporated by reference herein in its entirety.

What is claimed is:

1. An image forming apparatus comprising:

a sensor configured to detect a temperature;

an image forming unit configured to form an image;

a sheet container configured to contain sheets;

a sheet container heater configured to heat the sheets in the sheet container;

a fixing unit configured to fix the image on a sheet by heating the image on the sheet, the fixing unit having a fixing heater; and a controller configured to control a target temperature of the fixing heater when the fixing unit fixes the image on the sheet, wherein the controller is configured to control the target temperature of the fixing heater based on a detection result of the sensor, wherein the controller is configured to control the target temperature to be a first temperature when fixing the image on a predetermined sheet with the sheet container heater performing a heating operation, and wherein the controller is configured to control the target temperature to be a temperature lower than the first temperature when fixing the image on the predetermined sheet with the sheet container heater not performing the heating operation.

2. The image forming apparatus according to claim 1, wherein the heating operation of the sheet container heater is allowed in a standby mode in which the image forming unit does not form the image.

3. The image forming apparatus according to claim 1, wherein the heating operation of the sheet container heater is not performed while the image forming unit forms the image.

4. The image forming apparatus according to claim 1, wherein the image forming unit includes a photosensitive member, an exposure unit configured to expose the photosensitive member to form an electrostatic latent image, and a developing unit configured to develop the electrostatic latent image on the photosensitive member, wherein the image forming apparatus further includes a photosensitive member heater to heat the photosensitive member, and wherein the controller controls the target temperature based on a heating operation of the photosensitive member heater.

5. An image forming apparatus comprising:

a sensor configured to detect a temperature;

an image forming unit configured to form an image, the image forming unit having a photosensitive member, an exposure unit configured to expose the photosensitive member to form an electrostatic latent image, and a developing unit configured to develop the electrostatic latent image on the photosensitive member;

a photosensitive member heater configured to heat the photosensitive member;

a fixing unit configured to fix the image on a sheet by heating the image on the sheet, the fixing unit having a fixing heater; and a controller configured to control a target temperature of the fixing heater when the fixing unit fixes the image on the sheet, wherein the controller is configured to control the target temperature of the fixing heater based on a detection result of the sensor, wherein the controller is configured to control the target temperature to be a first temperature when fixing the image on a predetermined sheet with the photosensitive member heater performing a heating operation, and wherein the controller is configured to control the target temperature to be a temperature lower than the first temperature when fixing the image on the predetermined sheet with the photosensitive member heater not performing the heating operation.

6. The image forming apparatus according to claim 5, wherein the heating operation of the photosensitive member heater is allowed in a standby mode in which the image forming unit does not form the image.

7. The image forming apparatus according to claim 5, wherein the heating operation of the photosensitive member heater is not allowed while the image forming unit forms the image.

* * * * *